US005509235A

United States Patent [19]

Chander

[11] Patent Number: 5,509,235

[45] Date of Patent: Apr. 23, 1996

[54] SAFETY DEVICE FOR HINGED DOORS

[76] Inventor: Radhakrishnan Chander, 1515 Jeff Davis Hwy. #203, Arlington, Va. 22202

[21] Appl. No.: 435,423

[22] Filed: May 10, 1995

[51] Int. Cl.[6] ..... E05D 11/00

[52] U.S. Cl. ..... 49/383; 49/70; 160/40; 292/DIG. 17; 292/343

[58] Field of Search ..... 49/383, 460, 70; 160/40; 292/DIG. 17, DIG. 19, 343

[56] References Cited

U.S. PATENT DOCUMENTS

| | | | |
|---|---|---|---|
| 812,476 | 2/1906 | Becker | 292/DIG. 17 X |
| 1,260,192 | 3/1918 | Hall | 292/DIG. 19 X |
| 4,165,553 | 8/1979 | Salerno | 49/70 X |
| 4,648,152 | 3/1987 | Grewall | 292/DIG. 17 X |
| 4,878,267 | 11/1989 | Koach et al. | 49/383 X |
| 5,044,681 | 9/1991 | Neighbors | 292/DIG. 17 X |

FOREIGN PATENT DOCUMENTS

| | | | |
|---|---|---|---|
| 88/00306 | 12/1988 | WIPO | 49/383 |

*Primary Examiner*—Philip C. Kannan

[57] ABSTRACT

A safety device for hinged doors comprising a spring loaded wedge shaped stopper means. A bracket including a flat rectangular plate is attached to the front face along the edge near the hinge side of a hinged door at a sufficient height and out of reach from small children, by adhesive or other fastening means. A pair of opposing hinge walls are mounted orthogonally at the extremities on the front face of the rectangular plate. Said stopper means is hingedly attached to the rectangular plate by means of a hinge pin and a restoring spring. When the spring is not loaded, said stopper means is positioned naturally in an obtrusive manner in the front face gap near the hinge side created by the opening and closing of the hinged door, thereby preventing a partially opened door from being shut by small children who can accidently insert their fingers or other body parts into said gap. An adult desiring to close the door can do so by gently rotating the stopper about the hinge pin against the restoring spring, and away from said gap.

9 Claims, 2 Drawing Sheets

SAFETY DEVICE FOR HINGED DOORS

BACKGROUND

This invention relates to a safety device attached to hinged doors in the form of a spring loaded stopper means for preventing injuries to small children by precluding them from being able to close hinged doors that are left open.

On several occasions, in the process of manipulating a hinged door, a child injures itself severely by insertion of its fingers or other body parts in the gap created therein on the front face of a bi-fold door or the gap created between a hinged door and the fixed door frame. Also, it is very common among playful children to shut themselves alone inside a room by closing the hinged door, thereby causing considerable anxiety among parents and elders tending to such children.

In prior art, several devices have been proposed to address the first of the aforementioned problems. In U.S. Pat. No. 5,001,862 a foldable, accordian-like protective member that extends over at least a portion of the height of the front and/or rear face opening of a hinged door is proposed. In U.S. Pat. No. 5,092,077 a safety device covering the vertical edge of a hinged door and adjacent jamb on the hinge side is discussed. Both the devices, by folding and unfolding actions, cover up the gap created by the opening and closing of the hinged door. Such devices address only part of the problems commonly associated with hinged doors. Also, these devices are not portable, and are cumbersome to make, transport and install. In addition, these devices can daface the doors if they were to be removed for some reason.

SUMMARY

It is accordingly, a primary object of the present invention is to provide a portable, inexpensive and effective safety device for hinged doors that can be readily installed to an existing door.

Another object of the present invention is to provide a simple safety device for hinged doors that can address both the aforementioned problems commonly associated with hinged doors.

A further object of the present invention is to provide a portable safety device for hinged doors that can be easily and inexpensively manufactured and transported.

Yet another object of the present invention is to provide an effective safety device for hinged doors that is highly unobtrusive during an adult's normal intended usage.

In the preferred embodiment, the present invention relates to a safety device attached to banged doors comprising a wedge shaped stopper means. The hinged door could be part of a bi-fold door type or a door and adjacent fixed frame type. A first pair of opposing hinge walls are located at the rear surface of the stopper. A flat rectangular plate is attached on the front face along the edge near the hinge side of the hinged door at a sufficient height from the floor and out of reach from small children, by adhesive or other fastening means. A second pair of opposing hinge walls are mounted orthogonally at the extremities on the front face of the flat plate. The stopper is pivotally connected to the hinge walls on the flat plate by means of a hinge pin and a restoring spring.

When the door is in a fully closed position, the stopper stays clear of the door by pressing against and loading the restoring spring. When the door is partially opened by a certain amount, the restoring force of the spring slides the stopper into the gap created on the hinge side of the hinged door. This prevents the hinged door from being closed, without hindering further opening. At this point, the closing of the hinged door could only be achieved by gently rotating the stopper away from the door about the hinge pin, and pressing against the spring.

The various aspects of the present invention will be more fully understood when the following descriptions are read in conjunction with the accompanying diagrams.

DETAILED DESCRIPTION OF THE PREFERRED EMBODIMENTS

Figure 1:
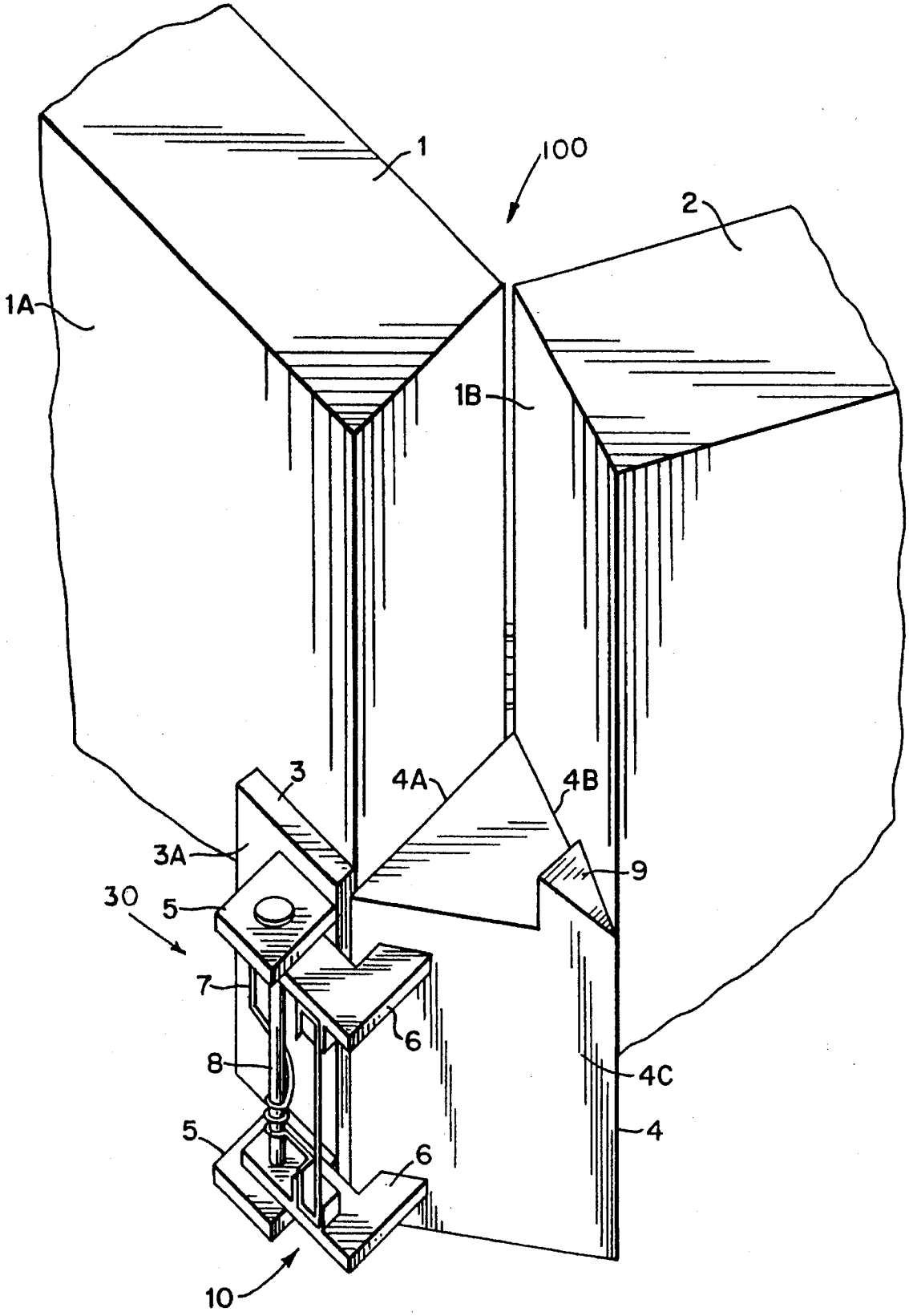
FIG. 1 is a perspective of the safety device locked in place in a bi-fold type door system.

FIG. 1 depicts a front perspective view of the safety device generally indicated by 10 as envisioned, in position in the gap 1B created between a swingable panel, generally indicated by the numeral 100, comprised of the hinged door 1 and another movable door 2 as in a bi-fold type door system. The safety device 10 comprises a bracket, generally indicated by the numeral 30, including a flat plate 3 attached to the front face 1A of the hinged door 1 near the edge along the hinge side of the hinged door 1. The flat plate 3 can be attached to the hinged door 1 either by adhesives or other fastening means. In general, adhesive means of attachment is preferred, as it will not leave any holes in the hinged door, if the safety device 10 were to be removed for some reason. A pair of opposing hinge walls 5 with holes are secured at the extremities on the front face 3A of the flat plate 3. The flat plate 3 along with the hinge walls 5 could be easily made out of molded plastic as a single piece.

The safety device 10 as shown in FIG. 1, further comprises a wedge shaped stopper 4 having a first pair of surfaces 4A and 4B forming the wedge shape. A third surface 4C connecting the first pair of surfaces 4A and 4B at the rear end of the stopper 4. A pair of opposing hinge walls or arms 6 are located on the third surface 4C to facilitate connecting the stopper 4 to the hinge walls 5 of bracket 30 located on the flat plate 3 by means of hinge pin 8 and a restoring spring 7. The stopper 4 along with hinge walls 6 could be fabricated as a single piece with molded plastic material. It is desirable to make the stopper 4 as a solid block. The spring 7 is of the torsional type, and is connected such that one end of the spring 7 is pressing against the hinge walls 6 and the other end is pressing against the flat plate 3, and the middle portion is wound around the hinge pin 8. The spring arrangement can be clearly seen in FIG. 1.

Figure 2:
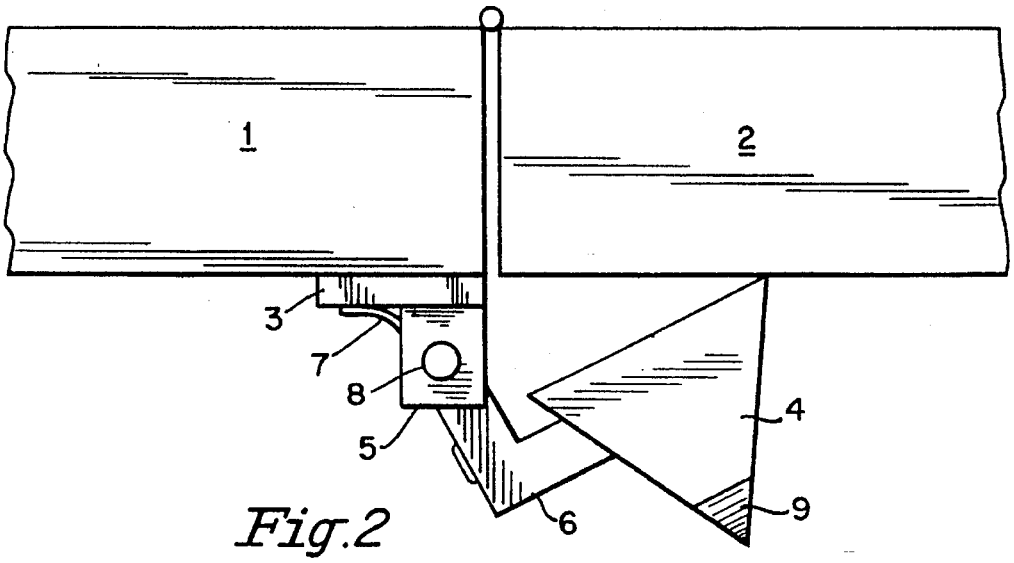
FIG. 2 is a top view of FIG. 1 when the bi-fold doors are completely shut.

In FIG. 2, the safety device is shown in place when the hinged doors 1 and 2 are in a fully closed position. At this position, the stopper 4 is pushed away by the hinged door against the spring 7 thereby loading the spring 7 in the process. When the hinged door 1 is opened by a certain amount, the restoring force of the spring 7 slides the stopper 4 back into the gap 1B. The stopper 4 thus positioned obtrusively prevents the hinged doors 1 and 2 from being closed without further intervention. On the other hand, the stopper 4 does not hinder further opening of the hinged doors 1 and 2. At this juncture, the closing of the hinged doors 1 and 2 could be achieved by gently swiveling the stopper 4 about the hinge pin 8, and against the restoring spring 7 by holding the lip 9 between fingers.

Figure 3:
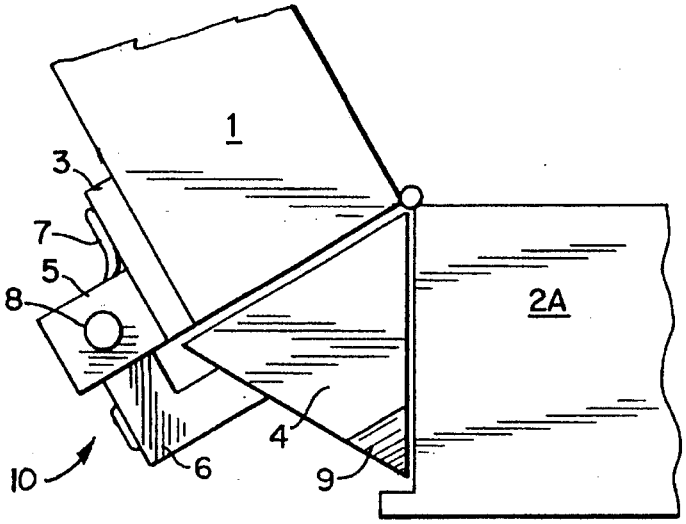
FIG. 3 is a top view of the safety device locked in place in a door and adjacent fixed frame system.

In FIG. 3, the safety device 10 is shown in place in a system where the hinged door 1 is attached to a fixed door frame 2A. In such a system, the functioning of the safety device 10 is identical to the one discussed earlier for the bi-fold type door system.

Figure 4:
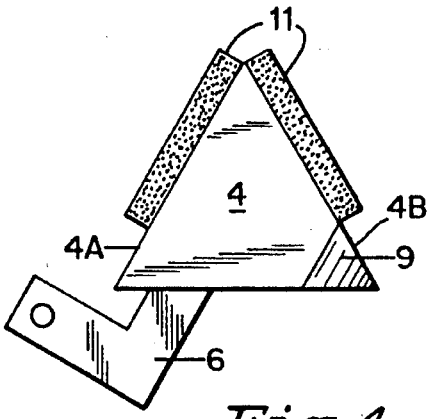
FIG. 4 is a top view of the stopper with attached frictional surfaces.

Frictional material 11 is adhered to the entire depth of surfaces 4A and 4B of the stopper 4 as shown in FIG. 4. The frictional material 11 could be made of, for example, felt, rubber or foam, and are provided to preclude the stopper 4 engaged in the gap 1B, from slipping or sliding away from the hinged door 1 during the initial phase of closing of the hinged door 1.

Although the present invention has been presented and described herein with specific forms and embodiments thereof, persons with ordinary skills in this art may resort to various modifications and applications without deviating from the spirit and scope of the invention. For example, the axis of the hinge pin can be chosen to be in a horizontal direction as opposed to the vertical direction as illustrated in the diagrams. Also, instead of a spring loaded stopper, a gravity assisted stopper could be used.

What is claimed is:

1. A safety device for use with first and second members hinged together for relative swinging motion, said safety device being insertable in a gap between said first and second members, said safety device comprising bracket means for being secured to one of said first and second members, a stopper, hinge means carried by said bracket means, arms means connected between said hinge means and said stopper, and spring means disposed between said bracket means and said stopper for biasing said stopper relative to said bracket means.

2. A safety device as defined in claim 1 wherein said stopper is engageable with the other member of said first and second members, and spring means provides for urging said stopper toward said other member.

3. A safety device as defined in claim 1 wherein said hinge means is comprised of an elongated hinge pin, said hinge pin being carried by said arms means.

4. A safety device as defined in claim 1 wherein a finger lip is attached to said stopper for moving said stopper away from said gap.

5. A safety device as defined in claim 1 wherein said stopper is in the form of a wedge, and includes adjacent surfaces diverging towards said hinge means; said adjacent surfaces being located for being disposed between said first and second members.

6. A stopper as defined in claim 5 including frictional material being secured to said adjacent surfaces.

7. A safety device as defined in claim 1 in combination with said first and second members, one of said first and second members comprising a swingable panel movable from a closed position to an open position and forming a gap between said first and second members, and said safety device being automatically inserted into said gap for precluding movement of said swingable panel towards said closed position of said swingable panel.

8. The combination as defined in claim 7 wherein said swingable panel is a vertically oriented door.

9. The combination as defined in claim 7 wherein said safety device is carried by said swingable panel.

* * * * *